United States Patent [19]

Ficker et al.

[11] 4,159,802

[45] Jul. 3, 1979

[54] HEATING SYSTEM UTILIZING FUEL BEARING MULTI-TUBE WATER JACKET

[76] Inventors: Herman Ficker, 10461 Lockcrest Dr., Cincinnati, Ohio 45231; John Konrad, 4219 Runningfawn Dr., Cincinnati, Ohio 45239

[21] Appl. No.: 908,564

[22] Filed: May 22, 1978

[51] Int. Cl.[2] ..... F24D 5/00; F24D 9/00

[52] U.S. Cl. ..... 237/8 R; 126/121; 126/132; 237/53; 126/101

[58] Field of Search ..... 126/121, 132, 120, 101, 126/143, 133; 237/8 R, 53

[56] References Cited

U.S. PATENT DOCUMENTS

| | | | |
|---|---|---|---|
| 495,418 | 4/1893 | Lewis | 126/132 |
| 670,066 | 3/1901 | Smoak | 126/132 |
| 1,426,976 | 8/1922 | Gabet | 126/132 |
| 1,432,538 | 10/1922 | DeArmond | 126/121 |
| 2,172,711 | 9/1939 | Newton | 126/132 |
| 4,025,043 | 5/1977 | Cleer, Jr. | 126/121 |
| 4,046,320 | 9/1977 | Johnson et al. | 126/132 |
| 4,049,194 | 9/1977 | Tice et al. | 126/121 |
| 4,050,441 | 9/1977 | Horwinski | 126/132 |
| 4,050,626 | 9/1977 | Awalt, Jr. | 126/121 |
| 4,074,676 | 2/1978 | Thomas | 126/132 |

*Primary Examiner*—Henry C. Yuen

*Attorney, Agent, or Firm*—Melville, Strasser, Foster & Hoffman

[57] ABSTRACT

A heating system utilizing a fuel bearing multi-tube water jacket having a lower header, an upper header vertically spaced from the lower header, a plurality of spaced curvilinear hollow heat exchanging tubes connecting the manifolds, and a hollow plate-like baffle connected between the manifolds. The water jacket may be positioned within a conventional fireplace for supporting burning fuel to heat fluid circulated through the heat exchanging tubes and plate-like baffle for heating areas remote from the fireplace. The water jacket may be utilized in conjunction with a heat exchanger positioned within the warm air duct of a forced air furnace. A pump for circulating fluid through the water jacket and heat exchanger, and a blower associated with the forced air furnace are operated in response to the temperature of the heated fluid.

15 Claims, 4 Drawing Figures

HEATING SYSTEM UTILIZING FUEL BEARING MULTI-TUBE WATER JACKET

BACKGROUND OF THE INVENTION

1. Field of the Invention

The present invention relates generally to heating systems, and more particularly to a heating system utilizing a fuel bearing water jacket.

2. Description of the Prior Art

Numerous heating systems used in conjunction with conventional fuel burning fireplaces have been suggested by prior art workers for utilizing heat which would otherwise be wasted from wood burning fireplaces and the like. One particular type of fireplace incorporates a heat exchanger adjacent the burning fuel which transfers heat to a working fluid, such as water, circulating through the exchanger. The heat content of the fluid may then be utilized in areas remote from the fireplace for space or water heating purposes.

It has been found that a significant part of the heat produced by the burning fuel cannot be transferred to the working fluid, and hence is lost through the fireplace exhaust system. For example, in fireplace structures employing a multiplicity of hollow fluid bearing tubes as heat exchangers, sufficient spacing must be left between the tubes to permit combustion air to reach the burning fuel. This same limitation has prevented efficient use of fireplace structures using continuous fluid filled side and rear walls as the heat exchanging surface.

It has also been suggested to include the type of fluid heating fireplace described hereinabove as part of a forced air heating system by extracting heat carried by the fluid with a heat exchanger positioned in the cold air return of the furnace. It has been found, however, that this arrangement permits unnecessarily large amounts of heat to be transferred to the furnace itself, rather than to the area to be heated, thus resulting in inefficient operation of the system.

SUMMARY OF THE INVENTION

The heating system of the present invention overcomes the limitations of prior art heating systems through a fireplace structure which transfers significantly greater portion of the heat produced by the burning fuel to the area to be heated.

In particular, the heating systems comprises a fuel bearing multi-tube water jacket grate having a lower header, an upper header vertically spaced from the lower header, a plurality of spaced curvilinear hollow heat exchanging tubes connecting the manifolds, and a hollow plate-like baffle connected between the manifolds and overlying the burning fuel. The heat exchanging tubes extend rearwardly from the lower manifold to form a support for bearing the combustible fuel. The rearmost ends of the tubes forming the platform extend upwardly to form the back wall of the water jacket, with the uppermost ends of the back wall tubes extending forwardly and upwardly at a slight angle to the upper manifold to form an awning-like canopy overlying the fuel bearing support. A fluid, principally water or a water/antifreeze mixture, is circulated through the heat exchanging tubes and the manifold, and is heated by the burning fuel positioned on the fuel bearing support. Fluid may be introduced at the lower manifold and withdrawn from the upper manifold for heating an enclosed area and the like. In a preferred embodiment, the baffle is positioned above the heat exchanging tubes forming the canopy, so that a large precentage of the heat passing therethrough may be captured and used to heat fluid flowing within the baffle.

To further increase the heat exchanging area of the tubes, while at the same time permitting sufficient air to reach the burning fuel to support combustion, the tubes are arranged in substantially parallel staggered relationship. Other features of the water jacket will become apparent from the description which follows.

The water jacket may also be utilized in connection with a forced air furnace to form a complete heating system for heating areas remote from the fireplace. In this embodiment, heated fluid from the water jacket is passed through a heat exchanger positioned within the warm air duct of the forced air furnace so that air passing thereover is heated. A pump continuously circulates fluid between the water jacket and the heat exchanger. A thermostat may be used to sense the temperature of the fluid to activate the pump and/or the blower associated with the forced air furnace when necessary. The entire system is operated at a relatively low fluid pressure which greatly reduces the possibility of rupture. A fluid storage reservoir automatically adds fluid to the system as required.

DESCRIPTION OF THE PREFERRED EMBODIMENTS

Figure 1:
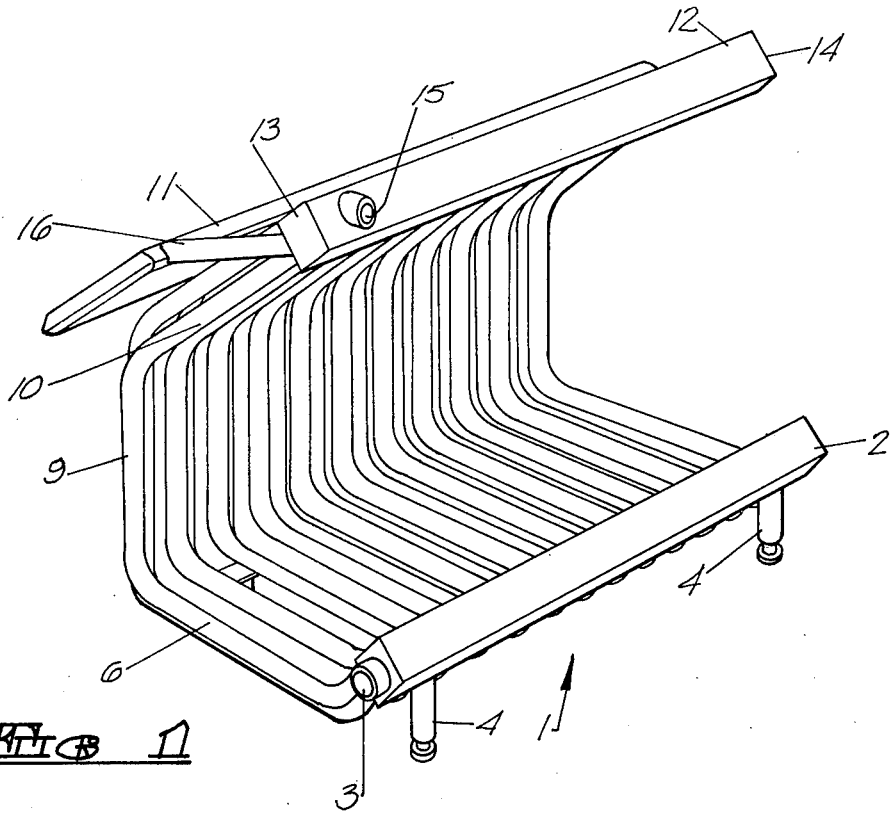
FIG. 1 is a perspective view of the water jacket of the heating system of the present invention.
Figure 2:
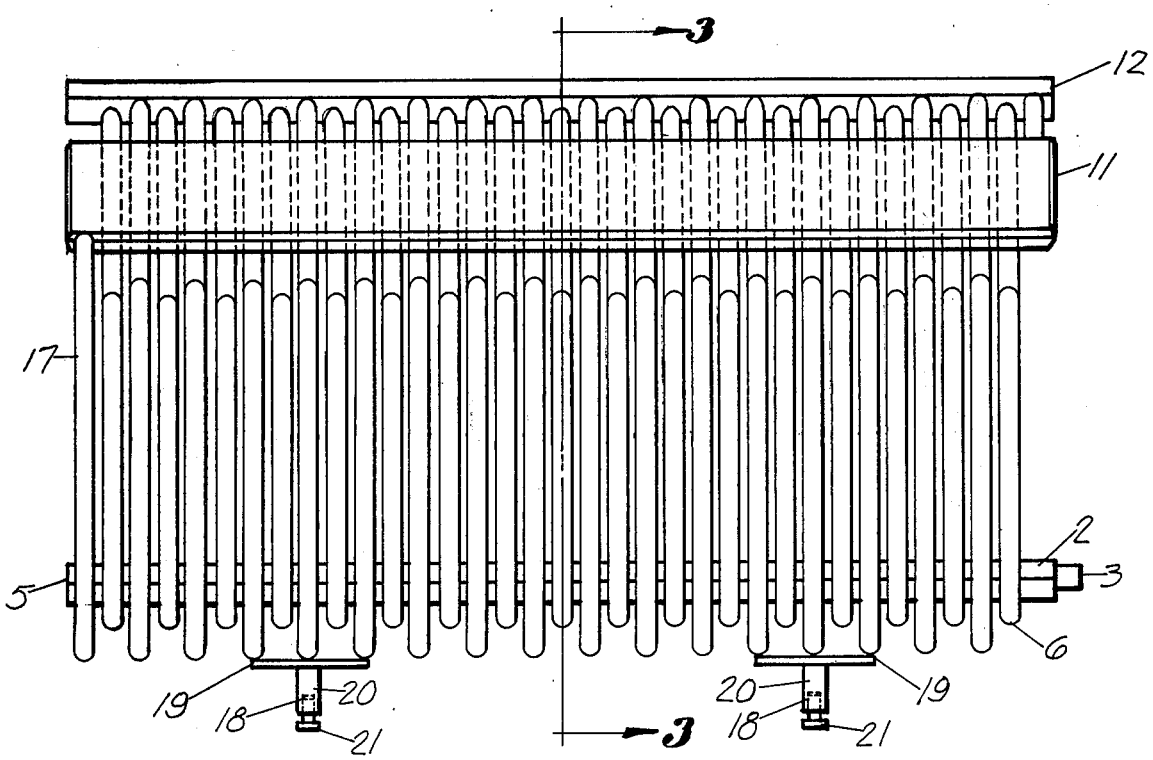
FIG. 2 is a rear elevation view of the water jacket of the present invention.
Figure 3:
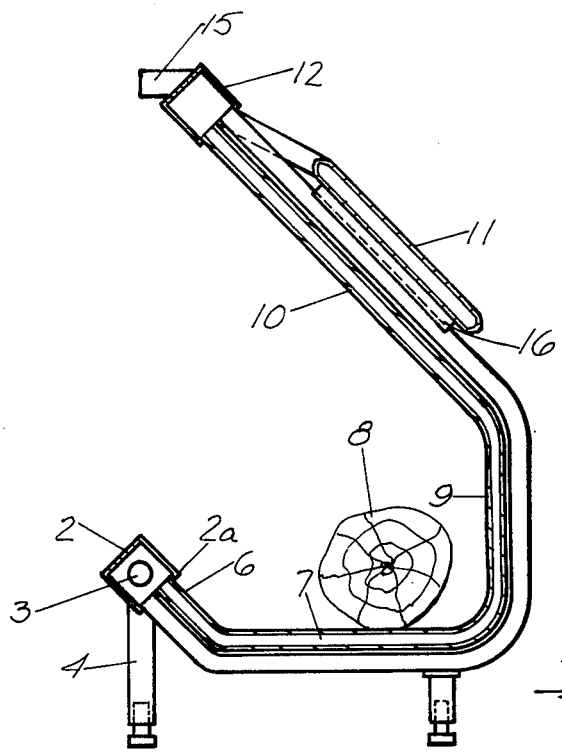
FIG. 3 is a section view taken along section lines 3—3 of FIG. 2.

FIG. 1 represents a front perspective view of the fuel bearing multi-tube water jacket, shown generally at 1, of the heating system of the present invention. Water jacket 1 comprises a lower elongated box-like hollow header 2 having a fluid inlet 3 located at one end for receiving fluid. Header 2, which is substantially diamond-shaped in cross section, as can best be seen in FIG. 3, is supported by a pair of spaced downwardly depending tube-like legs 4 positioned near the ends of manifold 2. Legs 4 will be of such a length so as to position water jacket 1 at the proper distance from the fireplace hearth and to provide the required amount of slope for the fuel bearing section of the water jacket, as will be explained in more detail hereinafter.

The end of manifold 2 opposite fluid inlet 3 is closed, as at 5. In addition, it will be understood that fluid inlet 3 may be positioned on manifold 2 at any location which will facilitate connection to the fluid distribution system to be described hereinafter.

A plurality of downwardly extending spaced parallel hollow heat exchanging tubes 6 emerge from the rearwardly and downwardly inclined surface 2*a* of manifold 2, such that the interior of tubes 6 communicate with the hollow interior of manifold 2. Hence, fluid introduced by way of inlet 3 into manifold 2 will flow in parallel flow paths into heat exchanging tubes 6. These downwardly extending tubes 6 reduce noises such as "pinging" caused by the heated fluid within the tubes, and also provide a raised forward edge for the water jacket 1 to retain fuel therein as will become apparent hereinafter.

Tubes 6 continue substantially horizontally rearwardly to form a support section 7 for bearing combustible fuel 8 such as wood, coal and the like. It will be observed that the tubes 6 emerging from manifold 2 and forming fuel bearing support 7 are arranged in substantially parallel vertically staggered relationship. That is, the upper surfaces of alternating tubes are arranged in vertically spaced planar relationship. This arrangement increases the available heat collecting surface area of the tubes, while maintaining sufficient space between tubes 6 for air to reach the burning fuel to support combustion.

The rearmost ends of tubes 6 forming the fuel bearing platform 7 extend upwardly to form back wall 9 of water jacket 1. Again, it will be observed that tubes 6 are arranged in substantially parallel horizontal staggered relationship, again to provide maximum heat exchanging surface for the tubes and permit maximum combustion air to reach the burning fuel.

The uppermost ends of the tubes forming the back of water jacket 1 extend forwardly and upwardly to form an awning-like canopy 10 overlying fuel bearing support 7. As can best be seen in FIG. 3, canopy section 10 completely overlies fuel bearing section 7 so as to be exposed to all heat released by burning fuel 8 regardless of where the fuel is positioned on support 7. The tubes 6 forming canopy 10 are also arranged in substantially parallel vertically staggered relationship to permit heat released by the burning fuel to pass therebetween and encounter the overlying baffle 11, as will be described in more detail hereinafter.

The forwardmost ends of the tubes forming canopy 11 terminate in hollow upper manifold 12, which is similar in construction to lower manifold 2, such that the hollow interiors of tubes 6 forming canopy 10 communicate with the hollow interior of upper manifold 12. As illustrated in FIG. 1, upper manifold 12 includes closed ends 13 and 14, together with a forwardly directed fluid outlet 15 for exhausting heated fluid from water jacket 1. Although for purposes of an exemplary showing, outlet 15 is illustrated emerging from the upper front surface of manifold 12, it will be understood that outlet 15 may be positioned at any point on manifold 12 to facilitate leading heated fluid away from water jacket 1.

A flat plate-like hollow baffle 11 is positioned parallel to and overlying the upper surfaces of tubes 6 forming canopy 10 so as to capture heat passing between tubes 6. Baffle 11 may be supported by one or more downwardly depending rib-like flanges 16 depending from the lower surface of baffle 11 and attached to tubes 6 by welding or the like.

A hollow pipe-like conduit 16 connects the forwardmost edge of baffle 11 to upper header 12 near fluid outlet 15, so that fluid contained within baffle 11 may be circulated to header 12 and thereafter exhausted from fluid outlet 15.

Similarly, a curvilinear hollow pipe-like conduit 17 is connected between the opposite rearmost edge of baffle 11 and lower header 2, so that fluid introduced into lower header 2 may be circulated through conduit 17 into baffle 11. It will be observed that conduit 17 extends generally parallel to tubes 6, so that conduit 17 forms not only an additional heat exchanging element, but also forms part of fuel bearing support 7, back 9, and canopy 10.

The lower rear edge of water jacket 1 is supported by a pair of spaced adjustable legs 18. Legs 18 comprise a substantially horizontal plate 19 extending across and attached by welding or the like to the lowermost surfaces of several of tubes 6. Depending from plate 19 is a tube-like leg support 20 threadedly attached to adjustable leg section 21. The rear portion of water jacket 1 may thus be adjusted vertically by rotating adjustable leg portion 21 to the desired height.

While the water jacket 1 may be constructed of any suitable materials, it has been found advantageous to fabricate heat exchanging tubes 6 from black steel pipe, and baffle 11 from low carbon steel plate material.

Figure 4:
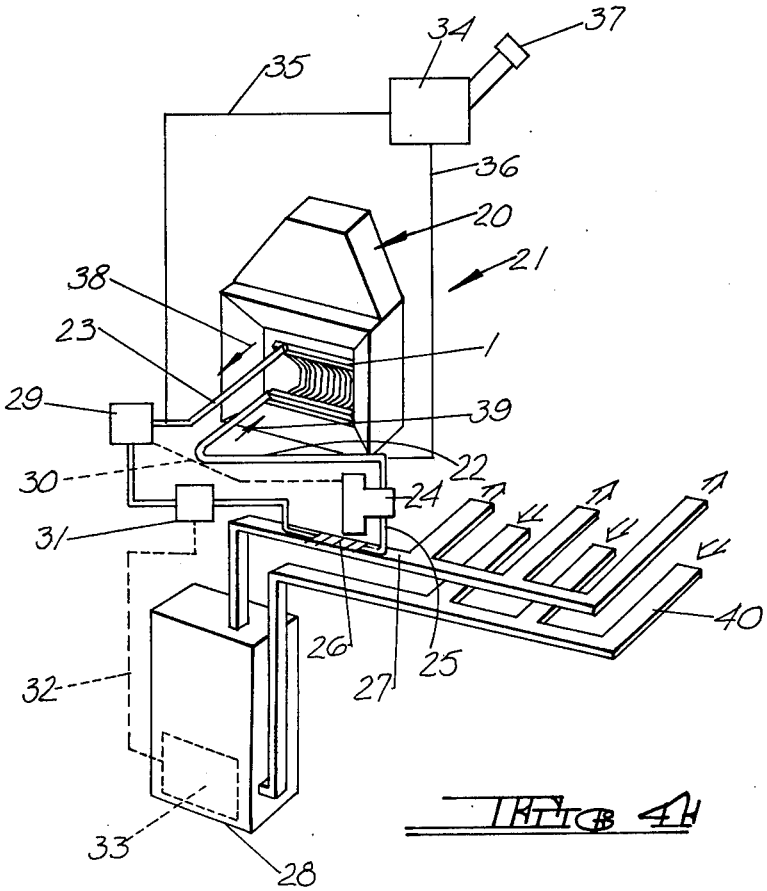
FIG. 4 is a diagrammatic view of the water jacket of FIG. 1 in association with a forced air heating system.

In operation, water jacket 1 is positioned in a suitable fireplace enclosure, such as that shown in FIG. 4 at 20, and the jacket filled with a suitable heat transfer fluid, such as water or a mixture of water and antifreeze. A combustible fuel 8 such as wood or coal, is placed on fuel bearing support 7 and ignited. Heat produced by the burning fuel will be transferred through heat transfer pipes 6 forming fuel bearing support 7, back 9, canopy 10 and baffle 11 to heat the heat transfer fluid contained therein. By circulating the fluid through water jacket 1, the heated fluid exhausted from fluid outlet 15 of upper header 12 may be used for space or water heating applications. It will be particularly observed that the presence of baffle 11 as an adjunct heat exchanger greatly increases the amount of heat that can be transferred to the fluid, thereby significantly increasing the efficiency of the water jacket and heating system associated therewith.

A typical heating system using water jacket 1 is illustrated generally at 21 in FIG. 4. In this configuration, water jacket 1 is positioned within a suitable fireplace structure 20 as described hereinabove. Fluid inlet 3 is connected to a supply conduit 22, while fluid outlet 15 is connected to an exhaust conduit 23. Supply conduit 22 is connected to the outlet of circulating pump 24. The inlet of circulating pump 24 is connected by means of conduit 25 to a heat exchanger 26 positioned in the warm air duct 27 of forced air furnace 28. A temperature sensor 29 monitors the fluid temperature in exhaust conduit 29 and provides an electrical signal to circulating pump 24 over electrical line 30 as will be described hereinafter. Temperature sensor 31 is also positioned to monitor the fluid temperature in exhaust conduit 23, and to supply an electrical signal over electrical conductor 32 to blower 33 located within forced air furnace 28.

A fluid storage tank 34 is positioned above water jacket 1, and connected to water jacket exhaust line 23 by inlet line 35 which permits excess fluid or vapor in the heating system to be returned to storage tank 34. Storage tank 34 is also connected to water jacket supply line 22 by means of outlet conduit 36 which permits fluid to flow by gravity back into the heating system as required.

In general, the fluid within the heating system will be substantially unpressurized. However, it may be desirable to operate the heating system at a minimal pressure, such as 12 psi, for example. In this event, a pressure vent 37 may be provided to insure that the system pressure does not exceed this minimum pressure level. The outlet of pressure vent 37 may be located exterior to the building in which the heating system is contained, as required.

In operation, combustible fuel such as wood or coal is placed on fuel bearing support 7 of water jacket 1 and ignited, thereby raising the temperature of the fluid contained within water jacket 1. When the temperature of the fluid reaches a predetermined temperature as sensed by temperature sensor 29, an electrical signal is sent over electrical conductor 30 to activate circulating pump 24. This causes the fluid to circulate in the directions shown by arrows 38 and 39 through water jacket 1 and heat exchanger 26 positioned within warm air duct 27 of forced air furnace 28.

When the circulating fluid reaches a second predetermined temperature as sensed by temperature sensor 31, an electrical signal is transmitted over electrical conductor 32 to activate blower 33 of furnace 28 to move air into cool air ducts 40 and exhaust air from warm air ducts 27, as indicated by the directions of the respective arrows in FIG. 4. As air passes through warm air ducts 27, it is warmed by the heated fluid passing through heat exchanger 26, and can thus be used to heat other areas remote from the heating system. By positioning heat exchanger 26 in warm air duct 27, heat is not lost through furnace 28.

It will be observed that any excess fluid retained in the heating system, or vapors produced by heating of the fluid, will be vented through conduit 35 to storage tank 34. If the pressure within the system exceeds a predetermined value, pressure vent 37 will open, maintaining the internal pressure of the system at a safe level. Furthermore, additional fluid will be supplied to the heating system as required by gravity flow through conduit 36 from storage tank 34. Thus the entire operation of the system is automatic, requiring minimal human intervention.

It will be understood that various changes in the details, materials, steps and arrangements of parts, which have been herein described and illustrated in order to explain the nature of the invention, may be made by those skilled in the art within the principal and scope of the invention as expressed in the appended claims.

The embodiments of the invention in which an exclusive property or privilege is claimed are as follows:

1. A heating system comprising a fuel bearing multi-tube water jacket, said jacket having a lower header, an upper header vertically spaced from said lower header, a plurality of spaced curvilinear hollow heat exchanging tubes connecting said manifolds, and a hollow plate-like baffle connected between said manifolds, said upper manifold having a fluid outlet for exhausting fluid from said water jacket, said lower manifold having a fluid inlet for receiving fluid, said heat exchanging tubes extending rearwardly from said lower manifold to form a support for bearing combustible fuel, the rearmost ends of said tubes forming said platform extending upwardly to form the back wall of said jacket, the uppermost ends of said tubes forming said back extending forwardly to said upper manifold to form an awning-like canopy overlying said fuel bearing support, said baffle being positioned to overlie said fuel bearing support and having an inlet connected to said lower manifold and an outlet connected to said upper manifold, whereby fluid introduced at said lower manifold inlet may be circulated through said heat exchanging tubes and said baffle, said fluid being heated as a result of heat produced by burning said combustible fuel positioned on said fuel bearing support, said heated fluid being withdrawn from said upper manifold outlet for heating an enclosed area and the like.

2. The heating system according to claim 1 wherein said baffle overlies said canopy.

3. The heating system according to claim 1 wherein said tubes forming said fuel bearing support are arranged in substantially parallel vertically staggered relationship.

4. The heating system according to claim 1 wherein said tubes forming said back are arranged in substantially parallel horizontally staggered relationship.

5. The heating system according to claim 1 wherein said tubes forming said canopy are arranged in substantially parallel vertically staggered relationship.

6. The heating system according to claim 1 wherein said canopy substantially completely overlies said fuel bearing support.

7. The heating system according to claim 6 wherein said canopy slopes upwardly and forwardly away from said back.

8. The heating system according to claim 1 wherein the portion of said fuel bearing support adjacent said lower manifold slopes downwardly and rearwardly toward said back.

9. The heating system according to claim 1 wherein said jacket includes means for adjusting the inclination of said fuel bearing support.

10. A heating system comprising:

water jacket means for transferring heat from burning fuel to a fluid, said water jacket means having an inlet receiving relatively cool fluid and an outlet exhausting heated fluid;

a forced air furnace having a cold air duct conducting unheated air thereto and a warm air duct conducting heated air therefrom;

heat exchanger means having an inlet and an outlet positioned within said warm air duct, said heat exchanger means inlet being connected to said water jacket means outlet, said heat exchanger means outlet being connected to said water jacket means inlet, said heat exchanging means transferring heat from said fluid to air within said warm air duct;

pump means interposed between said heat exchanger means and said water jacket means for circulating said fluid from said water jacket means to said heat exchanger means and from said heat exchanger means to said water jacket means, said water jacket means comprises a fuel bearing multi-tube water jacket, said jacket having a lower header, an upper header vertically spaced from said lower header, a plurality of spaced curvilinear hollow heat exchanging tubes connecting said manifolds, and a hollow plate-like baffle connected between said manifolds, said upper manifold having a fluid outlet for exhausting fluid from said water jacket, said lower manifold having a fluid inlet for receiving fluid, said heat exchanging tubes extending rearwardly from said lower manifold to form a support for bearing combustible fuel, the rearmost ends of said tubes forming said platform extending upwardly to form the back wall of said jacket, the uppermost ends of said tubes forming said back extending forwardly to said upper manifold to form an awning-like canopy overlying said fuel bearing support, said baffle being positioned to overlie said fuel bearing support and having an inlet connected to said lower manifold and an outlet connected to said upper manifold, whereby fluid introduced at said lower manifold inlet may be circulated through said heat exchanging tubes and said baffle, said fluid being heated as a result of heat produced by burning said combustible fuel positioned on said fuel bearing support, said heated fluid being withdrawn from said upper manifold outlet for heating an enclosed area and the like.

11. The heating system according to claim 10 wherein said system includes pressure relief means for maintaining a relatively low pressure in said fluid.

12. The heating system according to claim 10 including fluid storage means for automatically adding fluid to said system.

13. The heating system according to claim 12 wherein said fluid storage means comprises a fluid storage reservoir positioned above said water jacket means, said fluid flowing by gravity from said reservoir to said water jacket means.

14. The heating system according to claim 10 including means for sensing the temperature of said fluid, said temperature sensing means activating said pump means when the fluid temperature exceeds a first predetermined value.

15. The heating system according to claim 10 wherein said forced air furnace includes a blower for circulating air through said cold and warm air ducts, said system further including temperature sensing means for activating said blower when the temperature of said fluid exceeds a first predetermined temperature.

* * * * *